US009090079B2

(12) United States Patent
Kosugi

(10) Patent No.: US 9,090,079 B2
(45) Date of Patent: Jul. 28, 2015

(54) PRINTING APPARATUS AND INK PACK SET

(71) Applicant: Seiko Epson Corporation, Tokyo (JP)

(72) Inventor: Yasuhiko Kosugi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 227 days.

(21) Appl. No.: 13/975,702

(22) Filed: Aug. 26, 2013

(65) Prior Publication Data

US 2014/0063090 A1 Mar. 6, 2014

(30) Foreign Application Priority Data

Aug. 31, 2012 (JP) ..... 2012-191097

(51) Int. Cl.
*B41J 2/175* (2006.01)

(52) U.S. Cl.
CPC ..... *B41J 2/17566* (2013.01); *B41J 2/17509* (2013.01); *B41J 2/17546* (2013.01); *B41J 2/1752* (2013.01); *B41J 2/17533* (2013.01); *B41J 2/17543* (2013.01)

(58) Field of Classification Search
USPC ..... 347/7, 85, 86
See application file for complete search history.

(56) References Cited

U.S. PATENT DOCUMENTS

| | | | | |
|---|---|---|---|---|
| 6,722,762 | B2 | 4/2004 | Miyazawa et al. | |
| 8,091,997 | B2 | 1/2012 | Edwards | |
| 8,814,295 | B2 * | 8/2014 | Kosugi | 347/7 |

FOREIGN PATENT DOCUMENTS

| | | | | |
|---|---|---|---|---|
| EP | 1270236 | * | 1/2003 | B41J 2/175 |
| JP | 2003-034040 | | 2/2003 | |
| JP | 2003-127423 | | 5/2003 | |
| JP | 2008-254395 | | 10/2008 | |
| JP | 2010-132003 | * | 2/2010 | B41J 2/175 |

* cited by examiner

*Primary Examiner* — Huan Tran

(57) ABSTRACT

A printing apparatus includes first to n-th (n is an integer equal to or greater than 2) ink tanks in which ink accommodated in an ink pack is filled, first to n-th slots that correspond to the ink tanks, first to n-th memory units that are packaged together with the ink pack and are respectively installed in the slots, and a processing unit. The processing unit outputs a read-out command in which communication ID information is set, to the storage device included in the memory unit that is installed in the selected slot, determines whether ink color information that is read out and an ink color corresponding to the slot are consistent with each other, and determines that the memory unit is erroneously installed when the read-out ink color information and the ink color corresponding to the slot are inconsistent with each other.

8 Claims, 10 Drawing Sheets

PRINTING APPARATUS AND INK PACK SET

BACKGROUND

1. Technical Field

The present invention relates to a printing apparatus, an ink pack set, and the like.

2. Related Art

Ink cartridges (liquid containers) used in an ink jet type printing apparatus are provided with a storage device in order to manage the total ink consumption (ink consumption) of ink that is consumed from the cartridge. In addition, in a method of filling ink in an ink tank, rather than in an ink cartridge, which is provided in a printing apparatus, ink consumption is managed by installing a memory unit including a storage device in the printing apparatus. The storage device stores information, for example, an ink color or total ink consumption. Data regarding the total ink consumption is transmitted from a printing apparatus main body to the storage device, and is written in a non-volatile memory or the like which is included in the storage device. However, there is a concern of an ink cartridge or a memory unit being installed at an erroneous position when a user installs the ink cartridge or the memory unit in the printing apparatus. When the ink cartridge or the memory unit is installed at the erroneous position, the printing apparatus cannot perform a correct printing process.

With respect to the problems, for example, JP A-2003-34040 discloses a technique for preventing an ink cartridge from being installed at an erroneous position by providing an erroneous insertion preventing protrusion in the ink cartridge.

However, the technique has a problem that as the number of types of ink cartridges to be used increases, the shape of the erroneous insertion preventing protrusion becomes complicated, which results in a difficulty in securing a region for forming the protrusion.

SUMMARY

An advantage of some aspects of the invention is to provide a printing apparatus, an ink pack set, and the like capable of effectively detecting erroneous installation.

According to an aspect to the invention, there is provided a printing apparatus including a first ink tank to an n-th (n is an integer equal to or greater than 2) ink tank in which ink accommodated in an ink pack is filled; a first slot to an n-th slot that respectively correspond to the first ink tank to the n-th ink tank; a first memory unit to an n-th memory unit that are packaged together with the ink pack and are respectively installed in the first slot to the n-th slot; and a processing unit that controls read-out or writing of data with respect to the first memory unit to the n-th memory unit that are respectively installed in the first slot to the n-th slot. Each of the first memory unit to the n-th memory unit has a storage device. The storage device stores common communication ID information that does not depend on an ink color of the packaged ink pack, and ink color information corresponding to the ink color of the packaged ink pack. The processing unit selects the j-th (j is an integer satisfying the relation of $1 \leq j \leq n$) slot from the first slot to the n-th slot, outputs a read-out command in which the communication ID information is set, to the storage device included in the j-th memory unit of the first memory unit to the n-th memory unit, which is installed in the selected j-th slot, determines whether ink color information that is read out through the read-out command and an ink color corresponding to the j-th slot are consistent with each other, and determines that the j-th memory unit is erroneously installed when the read-out ink color information and the ink color corresponding to the j-th slot are inconsistent with each other.

In this case, the processing unit can detect the erroneous installation of the memory unit by outputting the read-out command in which the common communication ID information not depending on an ink color is set, to the first to n-th slots. In this manner, the erroneous installation can be detected by transmitting the read-out command once to one slot. In addition, even when data cannot be read out due to, for example, a memory error or a communication error, it can be determined to be an error by transmitting the read-out command once. As a result, time required to detect the erroneous installation can be reduced, thereby allowing the erroneous installation to be effectively detected.

In the aspect of the invention, each of the first memory unit to the n-th memory unit may have a storage device terminal. The processing unit may output a predetermined signal to the storage device terminal of the j-th memory unit that is installed in the selected j-th slot so as to set the storage device of the j-th memory unit to be in a communicable state, and may output the read-out command in which the communication ID information is set, to the storage device that is set to be in a communicable state.

In this case, the processing unit can output the predetermined signal to the j-th memory unit that is installed in the j-th slot, and can output the read-out command, and thus the processing unit can select the j-th memory unit to read out the ink color information.

In addition, in the aspect of the invention, each of the first memory unit to the n-th memory unit may have a reset terminal as the storage device terminal. The processing unit may output a reset release signal as the predetermined signal to the reset terminal so as to set the storage device to be in a communicable state.

In this case, the reset release signal can be output to one of the first to n-th memory units, and the read-out command can be output, and thus one memory unit can be selected so as to read out the ink color information.

In addition, in the aspect of the invention, each of the first memory unit to the n-th memory unit may have an installation detection terminal. The processing unit may detect that the j-th memory unit is installed in the j-th slot, using the installation detection terminal, and then may output the read-out command in which the communication ID information is set, to the storage device of the j-th memory unit.

In this case, the processing unit does not output the read-out command to the slot in which the memory unit is not installed, and thus time required to detect the erroneous installation can be reduced.

In addition, in the aspect of the invention, the processing unit may execute a process of counting ink consumption for each ink color during printing, may update total ink consumption information on the main body side for each ink color on the basis of the counted ink consumption, may write total ink consumption based on the total ink consumption information on the main body side with respect to the storage device of the memory unit corresponding to the ink color in the first memory unit to the n-th memory unit, every time an amount of increase in the total ink consumption based on the total ink consumption information on the main body side exceeds a first threshold value, and may set printing to be in an executable state even in a case where the memory unit corresponding to the ink color is not installed when the total ink consumption based on the total ink consumption information on the main body side is equal to or greater than a second threshold value for defining termination of use of the memory unit.

In this case, the processing unit can perform printing in a case where ink remains in the ink tank even when the total ink consumption based on the total ink consumption information on the main body side is equal to or greater than the second threshold value.

In addition, in the aspect of the invention, the printing apparatus may further include a slider that is installed in each of the first slot to the n-th slot. The k-th (k is an integer satisfying the relation of $1 \leq k \leq n$) memory unit of the first memory unit to the n-th memory unit may be detachably mounted on the slider, and the slider on which the k-th memory unit is mounted may be installed in the k-th slot of the first slot to the n-th slot, and thus the k-th memory unit may be installed in the k-th slot.

In this case, a user can detachably mount the memory unit in the slider and can install the slider on which the memory unit is mounted in the slot corresponding to the ink color, thereby allowing the memory unit to be installed in the corresponding slot.

According to another aspect of the invention, there is provided an ink pack set including an ink pack that accommodates ink to be used in a printing apparatus, and a memory unit that is installed in the printing apparatus. The memory unit may include a storage device, the storage device may store common communication ID information that does not depend on an ink color of the packaged ink pack and ink color information corresponding to the ink color of the packaged ink pack, the ink accommodated in the ink pack may be filled in an ink tank that is included in the printing apparatus, the memory unit may be installed in a slot, which is included in the printing apparatus and corresponds to the ink tank, and data may be read out or written under the control of a processing unit that is included in the printing apparatus, in the storage device of the memory unit that is installed in the slot.

In this case, a user can replenish ink in the ink tank corresponding to the ink color using the ink pack, which is packaged together with the ink pack set of a desired ink color, and the memory unit, and can install the memory unit in the corresponding slot. The processing unit of the printing apparatus can output a read-out command in which the common communication ID information is set, thereby allowing the ink color information corresponding to the ink color of the ink pack to be read out.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described in detail. Meanwhile, the present embodiment to be described below does not unduly limit the content of the invention described in the claims, and all of the features described in the present embodiment are not necessarily essential as means to resolve the invention.

1. Printing Apparatus

Figure 1:
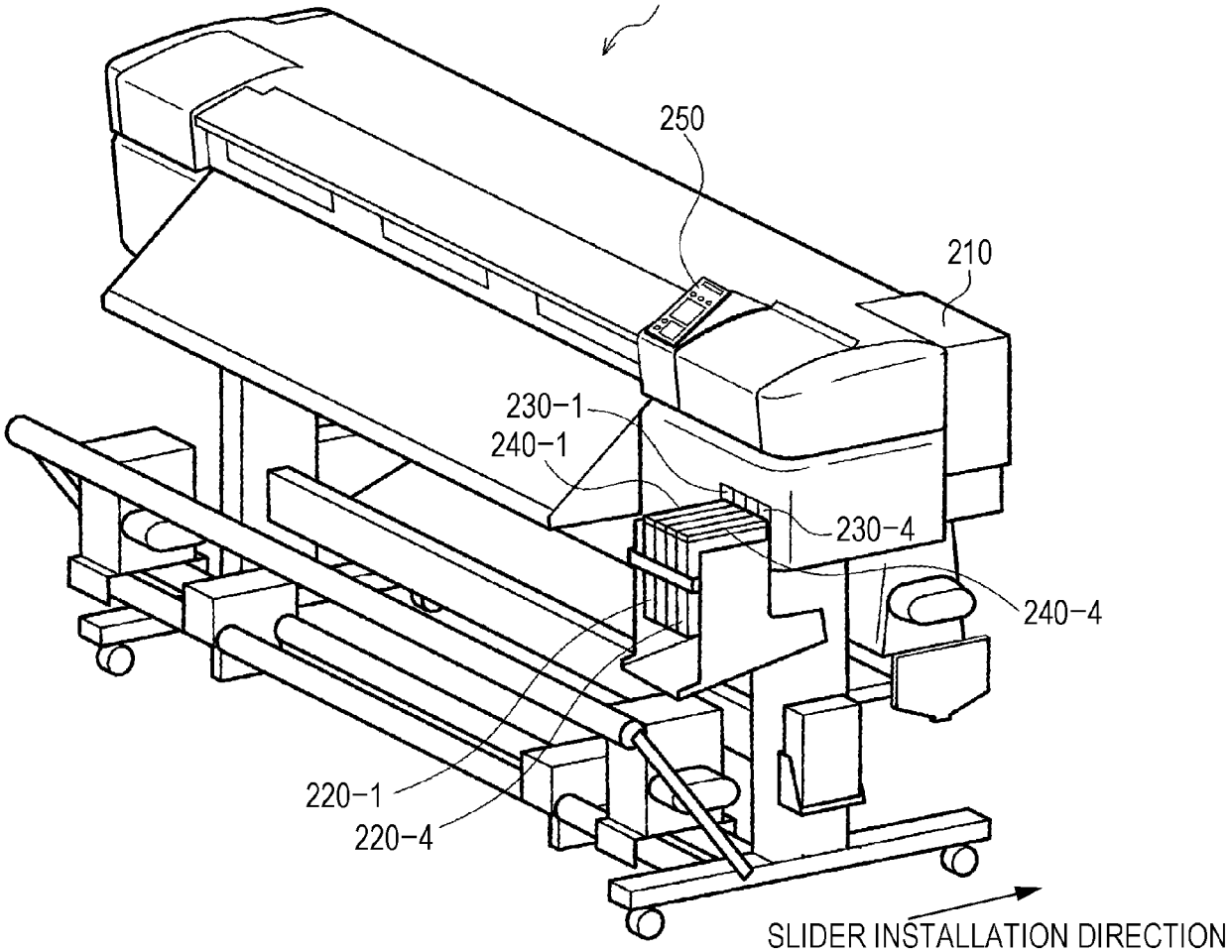
FIG. 1 is a perspective view illustrating a configuration example of a printing apparatus.

FIG. 1 is a perspective view illustrating a configuration example of a printing apparatus 200 according to the present embodiment. The printing apparatus 200 of the present embodiment includes first to n-th (n is an integer equal to or greater than 2) ink tanks 220-1 to **220-*n*, first to n-th slots 230-1 to 230-*n*, first to n-th memory units 100-1 to 100-*n*, sliders 240-1 to 240-*n*, a processing unit 210, and an operation unit 250. Meanwhile, the printing apparatus 200 of the present embodiment is not limited to the configuration illustrated in FIG. 1, and various modifications such as omission of some of its components, replacement with other components, or the addition of other components can be made. Although FIG. 1** illustrates a case of n=4, the relation of n=2 or n=3 may be established, or the relation of $n \geq 5$ may be established.

Meanwhile, in the description below, when there is no need to differentiate individual ink tanks with respect to the first to n-th ink tanks 220-1 to **220-*n*, the first to n-th ink tanks are appropriately referred to as an ink tank 220, and the same is true of the first to n-th slots 230-1 to 230-*n*, the first to n-th memory units 100-1 to 100-*n*, and the sliders 240-1 to 240-*n***.

Ink accommodated in an ink pack is filled in each of the first to n-th (n is an integer equal to or greater than 2) ink tanks 220-1 to **220-*n*. For example, a black ink is filled in the first ink tank 220-1, a yellow ink is filled in the second ink tank 220-2, a magenta ink is filled in the third ink tank 220-3, and a cyan ink is filled in the fourth ink tank 220-4. These kinds of ink are accommodated in different ink packs and are provided to a user. The user can fill (replenish) ink in the ink tank 220** corresponding to an ink color, from the ink pack of the ink color needed.

The first to n-th slots 230-1 to **230-*n* are used to install the sliders 240-1 to 240-*n* that can be attached to or detached from the printing apparatus 200 in the printing apparatus 200, and are provided so as to correspond to the first to n-th ink tanks 220-1 to 220-*n*. For example, the first to fourth slots 230-1 to 230-4 are provided on the first to fourth ink tanks 220-1 to 220-4** in which a black ink, a yellow ink, a magenta ink, and a cyan ink are respectively filled, so as to correspond to the first to fourth ink tanks, respectively.

The first to n-th memory units 100-1 to **100-*n* are packaged together with the ink pack, are provided to the user, and are respectively attached to the sliders 240-1 to 240-*n* by the user. The sliders 240-1 to 240-*n* to which the first to n-th memory units 100-1 to 100-*n* are attached are respectively installed in the first to n-th slots 230-1 to 230-*n*, and thus the memory unit 100 is installed in the slot 230. In FIG. 1, each memory unit 100 is installed in each corresponding slot 230, and thus the memory unit cannot be seen. Each of the first to n-th memory units 100-1 to 100-*n* includes a storage device 110** (not shown).

The storage device 110 previously stores common communication ID information that does not depend on an ink color of the packaged ink pack, ink color information corresponding to the ink color of the packaged ink pack, and the amount of ink filled in the packaged ink pack. For example, the storage device 110 included in the first memory unit 100-1, which is packaged together with the ink pack accommodating a black ink and is provided, previously stores the common communication ID information and the ink color information corresponding to black. The first memory unit 100-1 is then installed in the first slot 230-1. The total ink consumption information of the corresponding ink color is written by the processing unit 210, with respect to the storage device 110 of the memory unit 100 that is installed in each slot 230, in association with the execution of a printing process. The total ink consumption information is information of ink consumption rate data (a relative value) based on the amount of ink filled in the ink pack.

The sliders 240-1 to **240-*n* are respectively installed in the first to n-th slots 230-1 to 230-*n*. The k-th (k is an integer satisfying the relation of $1 \leq k \leq n$) memory unit 100-*k* in the first to n-th memory units 100-1 to 100-*n* is detachably mounted on the slider 240-*k* by a user. The slider 240-*k* on which the k-th memory unit 100-*k* is mounted is installed in the k-th slot 230-*k*, and thus the k-th memory unit 100-*k* is installed in the k-th slot 230-*k***.

The processing unit 210 includes a CPU 211, a storage unit 212, and a communication processing unit 213, and executes a printing process of the printing apparatus 200 and a communication process with each memory unit 100. Specifically, the processing unit controls read-out or writing of data with respect to the first to n-th memory units 100-1 to **100-*n* that are respectively installed in the first to n-th slots 230-1 to 230-*n*. In addition, the processing unit 210 executes a process of detecting whether the first to n-th memory units 100-1 to 100-*n* are respectively installed in the first to n-th slots 230-1 to 230-*n*. In addition, the processing unit 210 executes a process of counting ink consumption for each ink color during the printing, and a process of calculating total ink consumption information on the main body side WD (WD1 to WDn) of each ink color on the basis of the counted ink consumption and updating the total ink consumption information on the main body side WD of its own storage unit. In the process of counting the ink consumption for each ink color, the ink consumption is counted, including not only counting of ink that is consumed by printing but also counting of the consumption of ink that is consumed by the maintenance of a printing head of the printing apparatus 200**.

The operation unit 250 is an input device for executing various commands or settings by a user, and includes a display unit for executing various notifications to the user.

Figure 2:
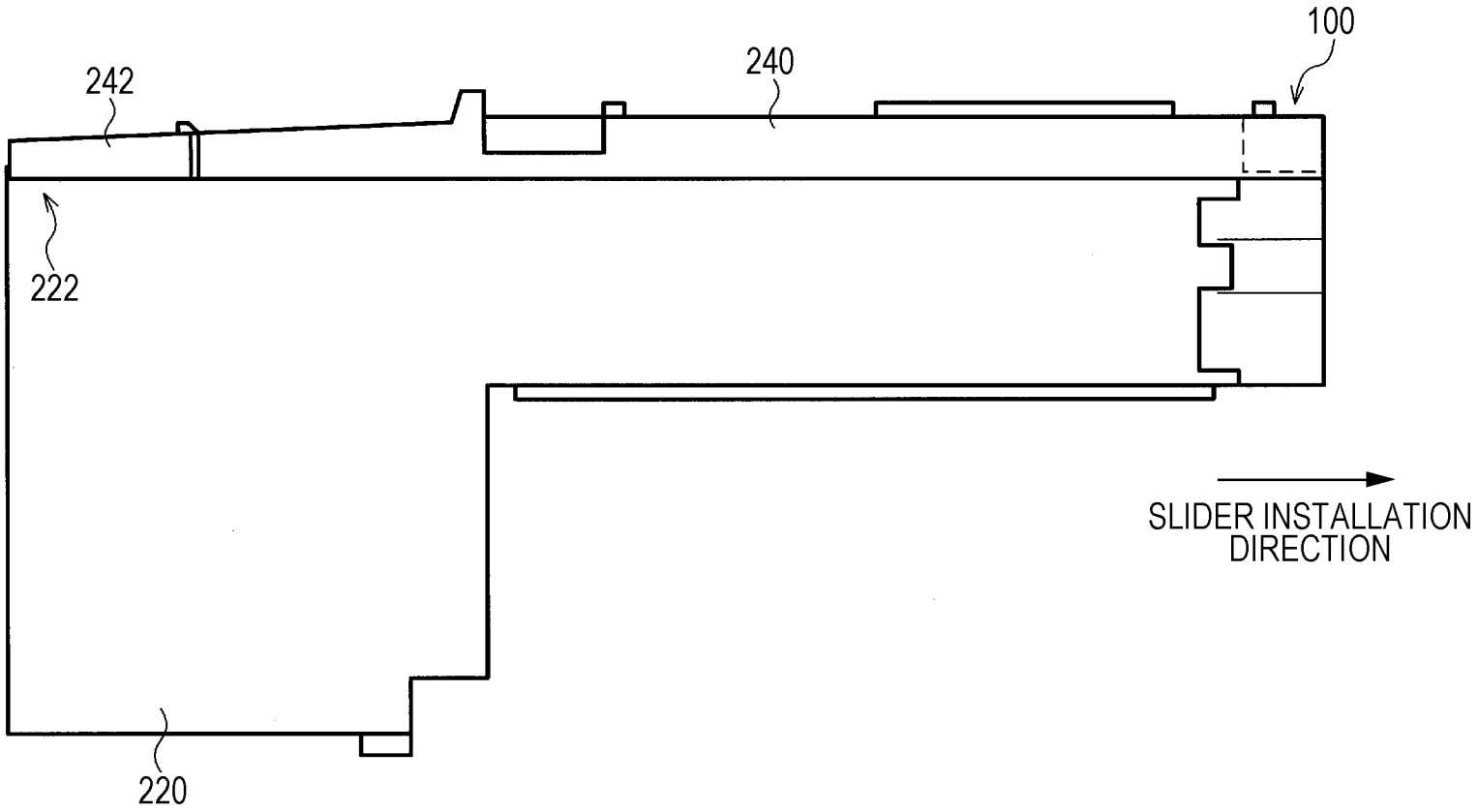
FIG. 2 is a side view illustrating a configuration example of an ink tank and a slider.

FIG. 2 is a side view illustrating a configuration example of the ink tank 220 and the slider 240 of the present embodiment. The ink tank 220 includes an ink supply port 222. A user can fill the ink accommodated in the ink pack from the ink supply port 222. The ink tank 220 is fixed to the printing apparatus 200, and the ink can be filled in a state where the ink tank is fixed to the printing apparatus. In a state where the slider 240 is installed in the slot 230, ink can be filled in the ink tank 220 by opening an ink supply port cover 242 of the slider 240.

The slider 240 can be attached to or detached from the printing apparatus 200 by sliding on the ink tank 220. When a user installs the memory unit 100 in the slot 230, the user pulls out the slider 240 from the slot 230, mounts the memory unit 100 on one end on the side toward the installation direction of the slider 240, and inserts the slider 240 again into the slot 230 along the installation direction. FIG. 2 illustrates a state where the memory unit 100 is mounted on the slider 240.

Figure 3:
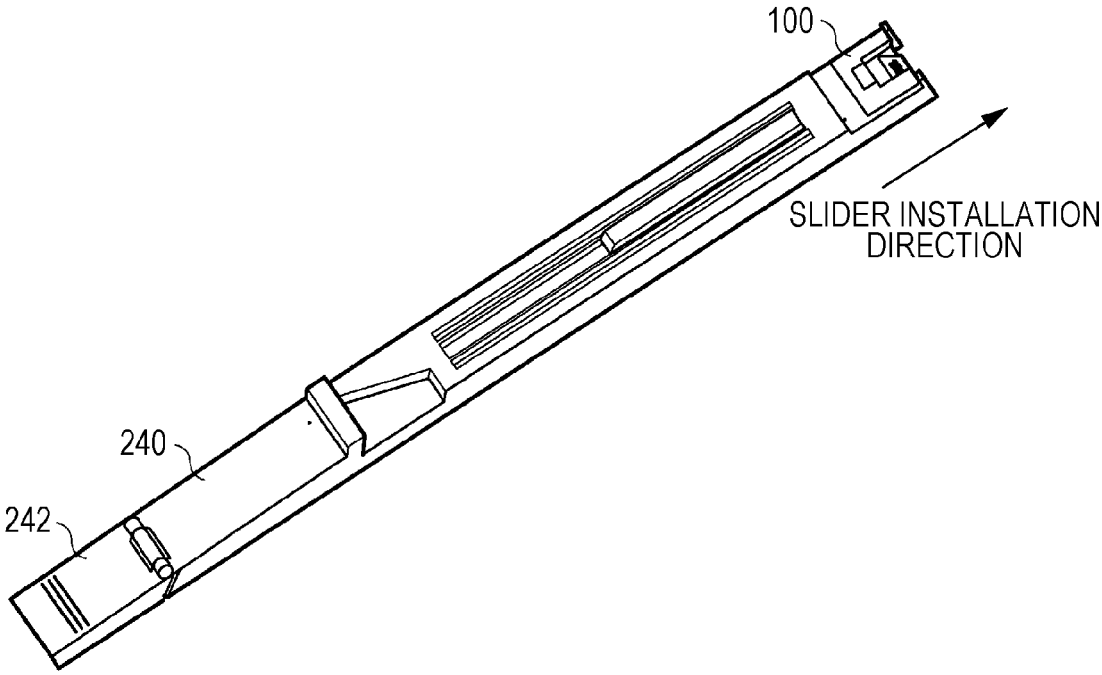
FIG. 3 illustrates a configuration example of the slider.

FIG. 3 illustrates a configuration example of the slider 240 of the present embodiment. As illustrated in FIG. 3, the memory unit 100 is detachably mounted on a tip portion on the side toward the installation direction of the slider 240. The phrase "detachably mounted" herein indicates that the memory unit 100 is placed without being fixed to the tip portion of the slider 240.

Figure 4:
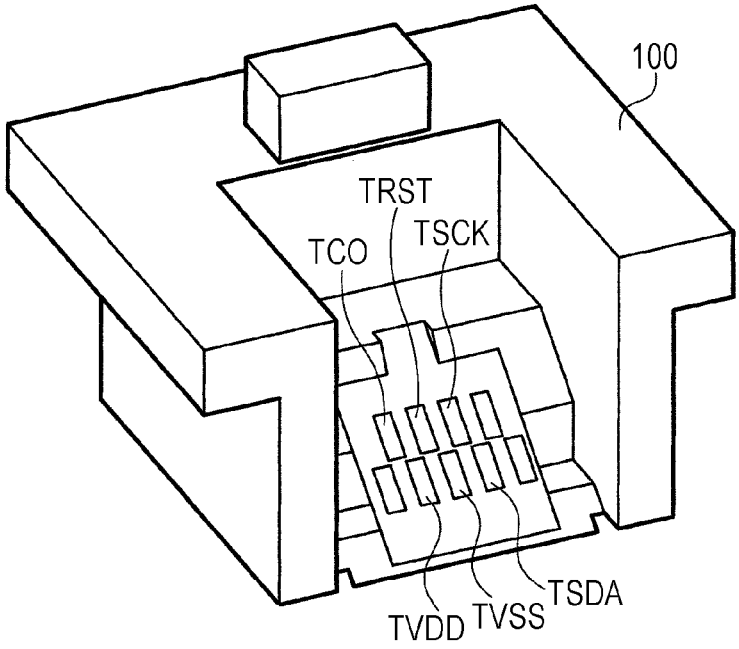
FIG. 4 illustrates a configuration example of a memory unit.

FIG. 4 illustrates a configuration example of the memory unit 100 of the present embodiment. The memory unit 100 includes the storage device 110 (not shown), a reset terminal TRST, a clock terminal TSCK, a data terminal TSDA, a first power terminal TVDD, a second power terminal TVSS, and an installation detection terminal TCO. These terminals are electrically connected to terminals on the main body side CRST, CSCK, CSDA, CVDD, CVSS and CCO of the printing apparatus 200 which are provided in the slot 230, respectively, by installing the memory unit 100 in the slot 230. Meanwhile, the reset terminal TRST, the clock terminal TSCK, the data terminal TSDA, the first power terminal TVDD, and the second power terminal TVSS are collectively referred to as a "storage device terminals". In addition, the number and arrangement of the terminals are not limited to those illustrated in FIG. 4, and can vary in various ways.

Figure 5:
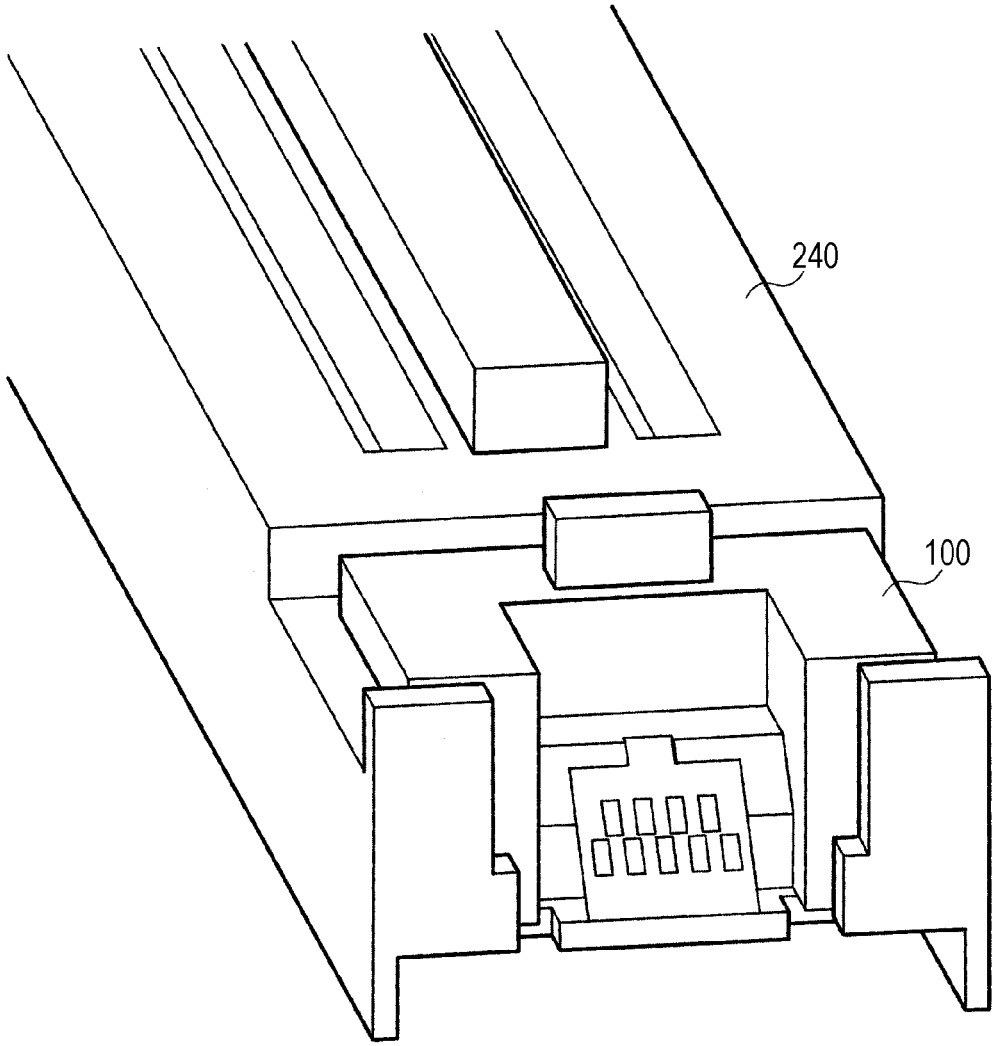
FIG. 5 illustrates a configuration example of a tip portion of the slider on which the memory unit is mounted.

FIG. 5 illustrates a configuration example of the memory unit 100 that is detachably mounted on the slider 240 of the present embodiment. As illustrated in FIG. 5, the memory unit 100 is mounted on the tip portion on the side toward the installation direction of the slider 240.

Figure 6:
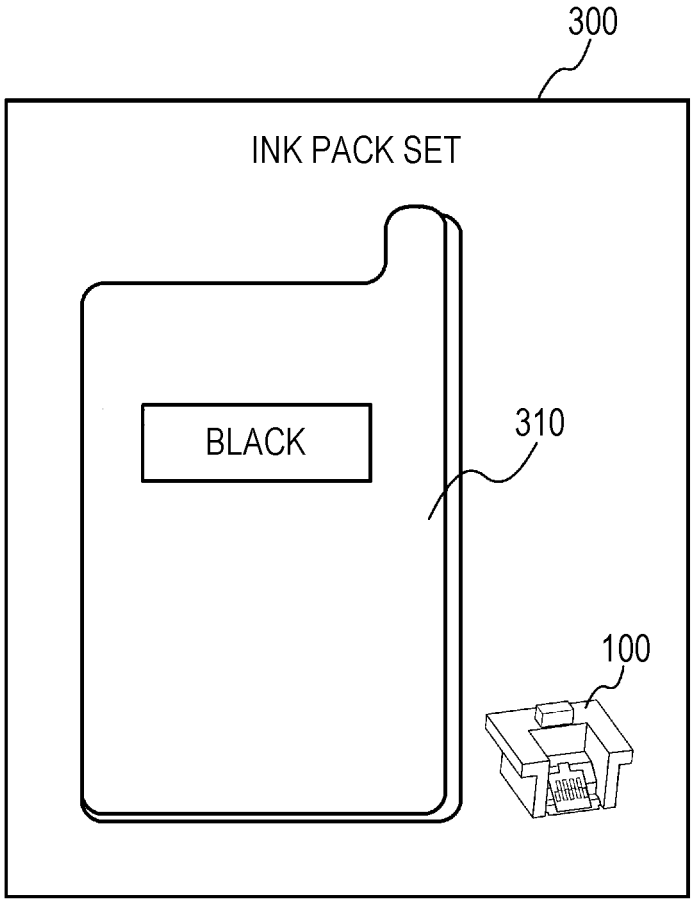
FIG. 6 illustrates a configuration example of an ink pack set.

FIG. 6 illustrates a configuration example of an ink pack set 300 of the present embodiment. The ink pack set 300 includes an ink pack 310 and the memory unit 100, which are packaged together therein. For example, the black ink pack set 300 includes the ink pack 310 accommodating a black ink and the memory unit 100 storing black ink color information, which are packaged together therein. In the ink pack 310, ink is filled in a bag (pouch pack) that is formed of, for example, a laminated film.

According to the printing apparatus 200 of the present embodiment, a user can continue printing by replenishing ink in the ink tank 220 in the case of a lack of ink within the ink tank 220.

Figure 7:
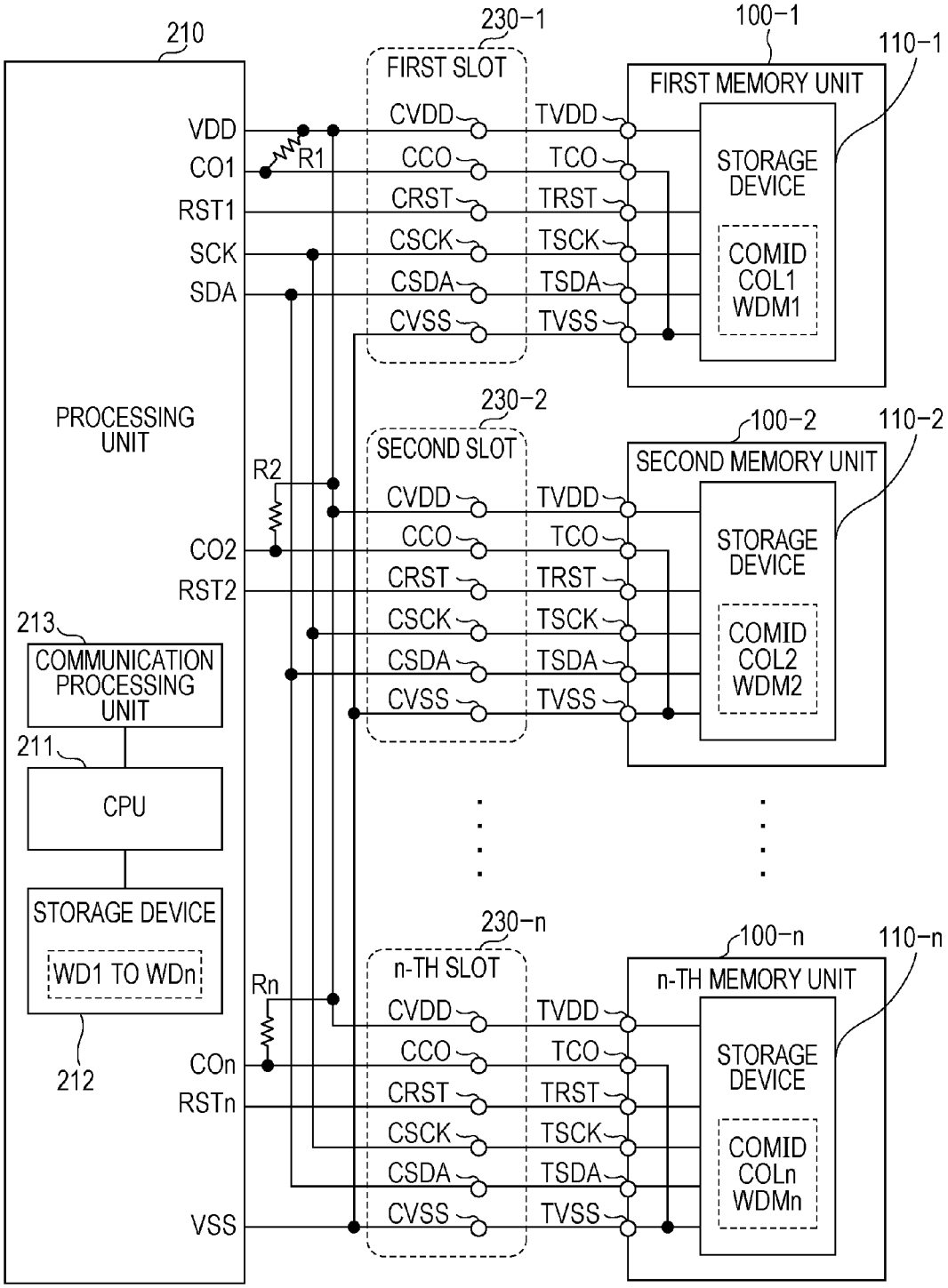
FIG. 7 illustrates a configuration example of first to n-th slots, first to n-th memory units, and a processing unit.

FIG. 7 illustrates a configuration example of the first to n-th slots 230-1 to **230-*n*, the first to n-th memory units 100-1 to 100-*n*, and the processing unit 210 of the printing apparatus 200 of the present embodiment. Meanwhile, the printing apparatus 200 of the present embodiment is not limited to the configuration shown in FIG. 7**, and various modifications such as omission of some of its components, replacement with other components, or the addition of other components can be made.

The first to n-th memory units 100-1 to **100-*n* include the reset terminal TRST, the clock terminal TSCK, the data terminal TSDA, the first power terminal TVDD, and the second power terminal TVSS, respectively, as storage device terminals. These storage device terminals are electrically connected to the storage device 110 that is included in each memory unit 100**.

In addition, each of the first to n-th memory units 100-1 to **100-*n* includes the installation detection terminal TCO. In each memory unit 100**, the installation detection terminal TCO is electrically connected to the second power terminal TVSS.

Each of the first to n-th memory units 100-1 to **100-*n* includes the storage device 110. Common communication ID information COMID that does not depend on an ink color of the packaged ink pack 310, ink color information COL (COL1 to COLn) corresponding to the ink color of the packaged ink pack 310, and the initial amount of ink filled in the packaged ink pack 310 are written in the storage device 110 when shipped from the factory. In addition, total ink consumption information WDM (WDM1 to WDMn) of the corresponding ink color is written by the processing unit 210 in the storage device 110, in association with the execution of the printing process. In addition, the storage device 110 includes a region for storing information indicating whether the use of the memory unit 100 is terminated. The storage device 110** can be constituted by a non-volatile memory such as an EEPROM.

The storage device terminals TRST, TSCK, TSDA, TVDD, and TVSS and the installation detection terminal TCO are electrically connected to the terminals on the main body side CRST, CSCK, CSDA, CVDD, CVSS, and CCO, respectively, which are provided in the first slot 230-1, by installing the first memory unit 100-1 in the first slot 230-1. The same is true of the second to n-th memory units 100-2 to **100-*n***.

In the terminals on the main body side which are provided in the first to n-th slots 230-1 to **230-*n*, the clock terminal CSCK, the data terminal CSDA, the first power terminal CVDD, and the second power terminal CVSS are commonly connected. The processing unit 210 outputs a clock signal SCK, a first power supply voltage (power supply voltage on the high-potential side) VDD, and a second power supply voltage (power supply voltage on the low-potential side) VSS to the clock terminal CSCK, the first power terminal CVDD, and the second power terminal CVSS, respectively. In addition, the processing unit 210** outputs a data signal SDA to the data terminal CSDA, and receives the data signal SDA from the data terminal CSDA.

The processing unit 210 outputs first to n-th reset release signals RST1 to RSTn to a reset terminal CRST that is provided in the first to n-th slots 230-1 to **230-*n***.

The processing unit 210 includes the CPU 211, the storage unit 212, and the communication processing unit 213, and executes a printing process of the printing apparatus 200 and a communication process with each memory unit 100. The storage unit 212 stores the total ink consumption information on the main body side WD (WD1 to WDn) of each ink color.

The processing unit 210 selects the j-th (j is an integer satisfying the relation of $1 \leq j \leq n$) slot **230-*j* in the first to n-th slots 230-1 to 230-*n*, and outputs a read-out command (a read-out command including communication ID information COMID) in which the communication ID information COMID is set, to the storage device 110 included in the j-th memory unit 100-*j* that is installed in the selected j-th slot 230-*j***.

Figure 10:
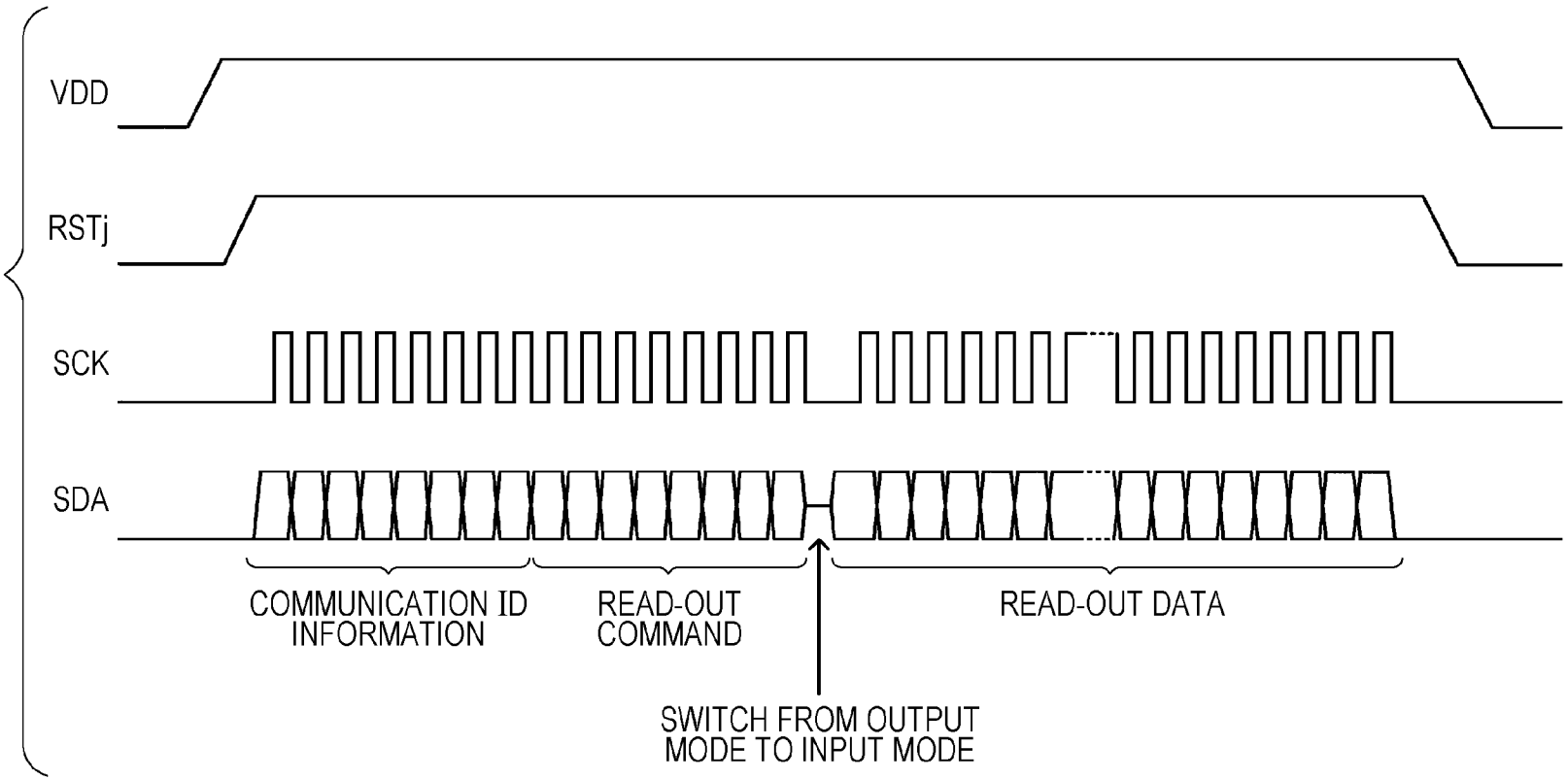
FIG. 10 is a timing chart illustrating an example of a read-out process with respect to a j-th memory unit.

The communication ID information COMID is ID information for designating the storage device 110 to be read out or written by the processing unit 210. For example, as illustrated in FIG. 10 to be described below, the communication ID information is set by being transmitted before the read-out command. The storage device 110 compares the stored communication ID information COMID with the received communication ID information COMID, and executes the received command when both are consistent with each other, but does not execute the command when both are not consistent with each other.

In the printing apparatus 200 of the present embodiment, each storage device 110 stores common communication ID information COMID that does not depend on an ink color, and thus it is not possible to select the storage device 110 which is an object of communication, using the communication ID information COMID. Consequently, in the printing apparatus 200 of the present embodiment, the storage device 110 which is an object of communication is selected, as will be described below.

The processing unit 210 outputs a predetermined signal to the storage device terminals of the j-th memory unit **100-*j* that is installed in the selected j-th slot 230-*j* so as to set the storage device 110 of the j-th memory unit 100-*j* to be in a communicable state. The processing unit then outputs the read-out command in which the communication ID information COMID is set, to the storage device 110 that is set to be in a communicable state. More specifically, the processing unit 210 outputs a reset release signal RSTj as a predetermined signal, to the reset terminal TRST of the selected j-th memory unit 100-*j*, so as to set the storage device 110 of the j-th memory unit 100-*j*** to be in a communicable state.

For example, when the first slot 230-1 is selected, the processing unit 210 sets the first reset release signal RST1 to be in an active state, and thus the storage device 110 of the first memory unit 100-1 is set to be in a communicable state. Similarly, when the second slot 230-2 is selected, the processing unit 210 sets the second reset release signal RST2 to be in an active state, and thus the storage device 110 of the second memory unit 100-2 is set to be in a communicable state. In this manner, the processing unit 210 can select one of the first to n-th memory units 100-1 to **100-*n* that are installed in the first to n-th slots 230-1 to 230-*n* and control read-out or writing with respect to the storage device 110 of the selected memory unit 100**.

The processing unit 210 can detect that the memory unit 100 is installed in the slot 230, using the installation detection terminal TCO. For example, when the detection of installation is performed on the first slot 230-1, the processing unit 210 outputs the first power supply voltage VDD to the first power terminal CVDD and detects whether the memory unit is installed, using a voltage level of the first installation detection signal CO1. The installation detection terminal on the main body side CCO of the first slot 230-1 is connected to the first power terminal CVDD through a resistance element R1, and thus the voltage level of the first installation detection signal CO1 is set to an H level (a high-potential level, a VDD level) when the memory unit 100 is not installed.

On the other hand, when the memory unit 100 is installed, the installation detection terminal on the main body side CCO, and the installation detection terminal TCO and the second power terminal TVSS of the memory unit 100 are electrically connected to each other, and thus the voltage level of the first installation detection signal CO1 is set to a L level (a low-potential level, a VSS level). Therefore, the processing unit 210 can determine that the memory unit is not installed when the first installation detection signal CO1 is in an H level, and can determine that the memory unit is installed when the first installation detection signal is in a L level. In this manner, the processing unit 210 can detect whether the memory unit 100 is installed in each of the first to n-th slots 230-1 to **230-*n***.

In the configuration example illustrated in FIG. 7, one of the first to n-th reset release signals RST1 to RSTn is selected and set to be in an active state, and thus one memory unit 100 is selected, but a method of selecting the memory unit 100 is not limited thereto. For example, when the processing unit 210 is configured to individually output the clock signal SCK to each slot 230, the j-th memory unit **100-*j* can be selected by outputting the clock signal SCK to only the j-th memory unit 100-*j*. Alternatively, when the processing unit 210 is configured to individually input and output the data signal SDA to each slot 230, the j-th memory unit 100-*j* can be selected by outputting the data signal SDA (for example, the read-out command) to only the j-th memory unit 100**-*j*.

A method of detecting the installation of the memory unit 100 is not limited to that illustrated in FIG. 7. For example, the installation of the memory unit may be detected by providing two installation detection terminals electrically connected to each other in the memory unit 100 and causing the processing unit 210 to detect electrical conduction between two installation detection terminals on the main body side (on the slot side) corresponding to the two installation detection terminals.

2. Detection of Erroneous Installation of Memory Unit

There is a concern that the user may erroneously install the memory unit 100 in the slot 230 corresponding to a different ink color when the user installs the memory unit in the slot 230. When the memory unit 100 is erroneously installed, the printing apparatus 200 cannot perform a correct printing process. Consequently, in the printing apparatus 200 of the present embodiment, the processing unit 210 reads out ink color information from the storage device 110 of the memory unit 100 that is installed in each slot 230, and determines whether the read-out ink color information and an ink color corresponding to the slot 230 are consistent with each other, in advance of the execution of the printing process. When the read-out ink color information and the ink color corresponding to the slot 230 are inconsistent with each other, the processing unit determines that the memory unit 100 is erroneously installed. When the processing unit 210 determines that the memory unit is erroneously installed, the processing unit executes a process of displaying an error message or the like. In this manner, it is possible to prevent the printing process from being executed in a state where the memory unit 100 is erroneously installed.

Figure 8:
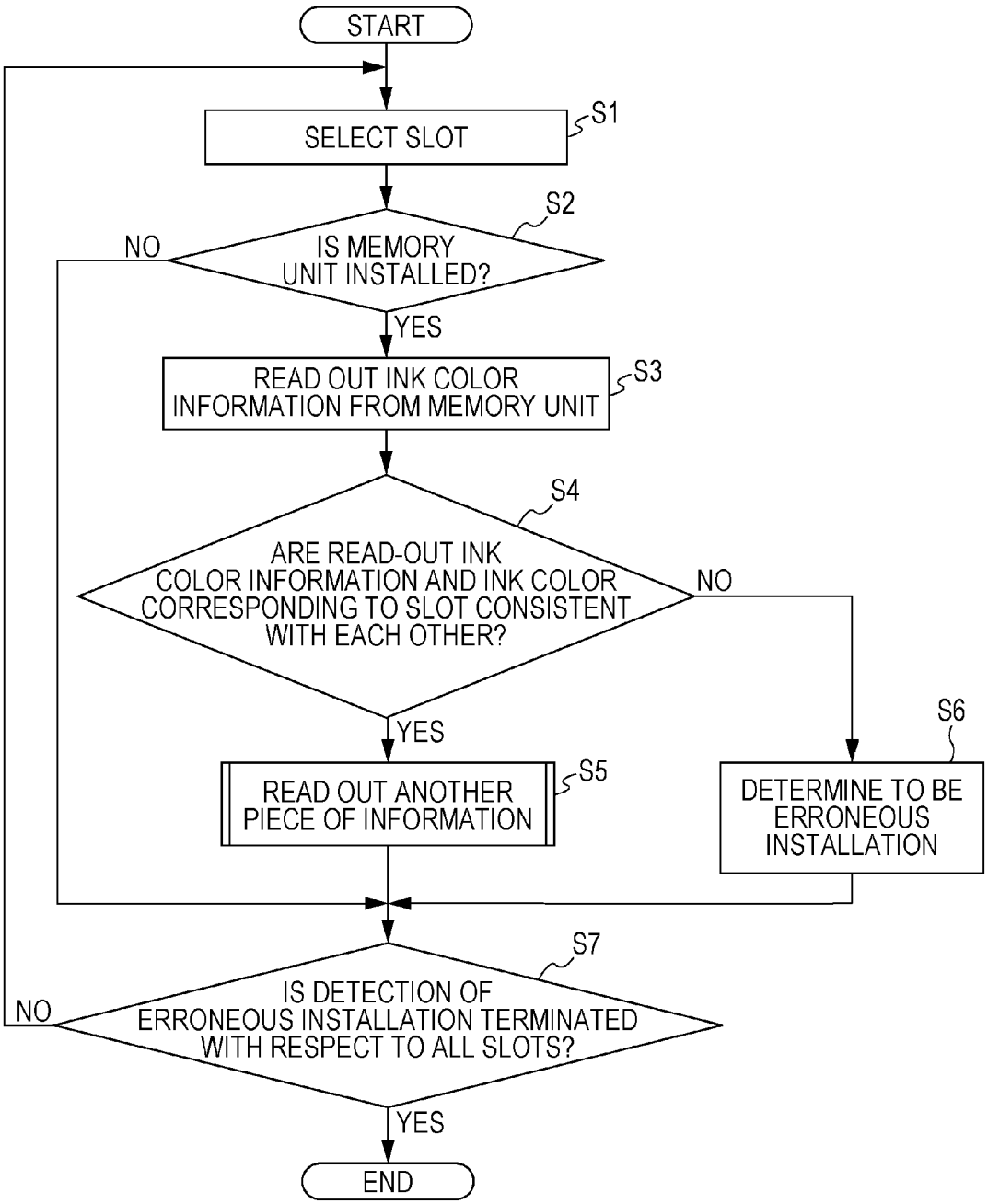
FIG. 8 is a flow chart illustrating an example of a process of detecting erroneous installation of the memory unit.

FIG. 8 is a flow chart illustrating an example of a process of detecting the erroneous installation of the memory unit 100 in the printing apparatus 200 of the present embodiment. A flow illustrated in FIG. 8 is executed by the processing unit 210.

In a first step S1, the processing unit 210 selects one slot 230 which is an object of erroneous installation detection. Specifically, the processing unit selects, for example, the first slot 230-1.

Subsequently, the processing unit 210 determines whether the memory unit 100 is installed in the selected slot (for example, the first slot 230-1) (step S2). Specifically, as described above, it is possible to detect whether the memory unit is installed, using the installation detection terminal CCO of the selected slot. When the memory unit 100 is installed in the selected slot, the process proceeds to step S3. On the other hand, when the memory unit is not installed in the selected slot, the process proceeds to step S7 without executing a read-out process.

In step S3, the processing unit 210 reads out the ink color information from the memory unit 100. Specifically, the processing unit outputs a read-out command to the memory unit 100 that is installed in the selected slot 230, and reads out the ink color information COL that is stored in the storage device 110 of the memory unit 100. The read-out process will be described below in detail.

Subsequently, the processing unit 210 determines whether the read-out ink color information COL and the ink color corresponding to the selected slot 230 are consistent with each other (step S4). For example, when the first slot 230-1 corresponding to black is selected, if the read-out ink color information COL is black, it is determined that both are consistent with each other. On the other hand, when the read-out ink color information COL is yellow, it is determined that both are inconsistent with each other. When both are consistent with each other, the processing unit 210 determines that the memory unit 100 is correctly installed, and thus the process proceeds to step S5. When both are inconsistent with each other, the processing unit 210 determines that the memory unit 100 is erroneously installed, and thus the processing unit displays an error message or the like for notifying the erroneous installation to a user.

When the memory unit 100 is correctly installed, the processing unit 210 reads out other pieces of information (for example, total ink consumption information WDM, unique ID information, use history information, and the like) from the storage device 110 of the memory unit 100 (step S5).

Subsequently, the processing unit 210 determines whether the detection of erroneous installation is terminated with respect to all the slots 230-1 to 230-*n* (step S7). When the detection of erroneous installation is not terminated with respect to all the slots 230-1 to 230-*n*, the process returns to step S1 to select the next slot (for example, the second slot 230-2), and the process of step S2 and the subsequent processes are repeated. When the detection of erroneous installation is terminated with respect to all the slots 230-1 to 230-*n*, the process is terminated.

3. Read-Out Process with Respect to Storage Device

Figure 9:
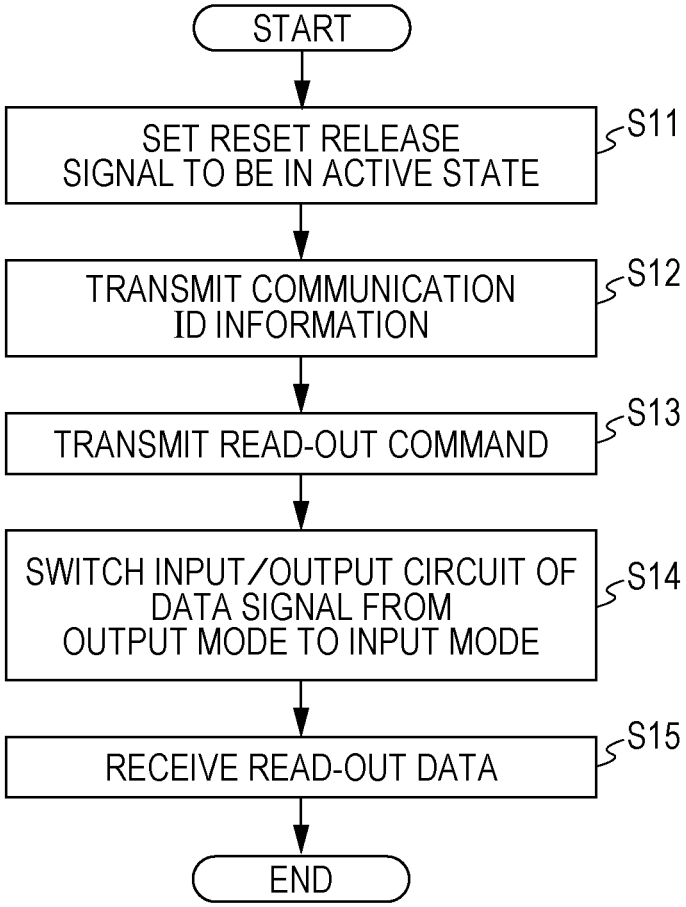
FIG. 9 is a flow chart illustrating an example of a read-out process with respect to the memory unit.

FIG. 9 is a flow chart illustrating an example of a read-out process with respect to the memory unit 100 in the printing apparatus 200 of the present embodiment. A flow illustrated in FIG. 9 illustrates the read-out process of step S3 in FIG. 8 in more detail, and is executed by the processing unit 210.

First, the processing unit 210 sets the reset release signal RST1 corresponding to a selected slot, for example, the first slot 230-1, to be in an active state (for example, an H level) (step S11). A reset state of the storage device 110 of the memory unit 100-1 that is installed in the first slot 230-1 is released and is set to be in a communicable state by setting the reset release signal RST1 to be in an active state.

Subsequently, the processing unit 210 transmits the communication ID information COMID as the data signal SDA, to the memory unit 100-1 (step S12). The communication ID information COMID is common communication ID information that does not depend on an ink color, and the same ID information is used with respect to the first to n-th memory units 100-1 to 100-*n*.

Next, the processing unit 210 transmits a read-out command as the data signal SDA, to the memory unit 100-1 (step S13). The storage device 110 of the memory unit 100-1 reads out, for example, the ink color information COL, in response to the received read-out command.

Subsequently, the processing unit 210 switches an input/output circuit of the data signal SDA from an output mode to an input mode (step S14). In this manner, the processing unit 210 can receive the data signal SDA from the memory unit 100-1.

Subsequently, the processing unit 210 receives read-out data (the ink color information COL) from the memory unit 100-1 (step S15), and then terminates the read-out process.

FIG. 10 is a timing chart illustrating an example of a read-out process with respect to the j-th memory unit 100-*j*. FIG. 10 illustrates the first power supply voltage VDD, the j-th reset release signal RSTj, the clock signal SCK, and the data signal SDA.

After the first power supply voltage VDD rises to a predetermined voltage, the j-th reset release signal RSTj is set to be in an active level (an H level). In this manner, the reset state of the storage device 110 of the j-th memory unit 100-*j* is released, and thus the storage device is set to be in a communicable state. At this time, a reset state of the storage device 110 of another memory unit 100 is maintained.

The processing unit 210 outputs the clock signal SCK, and transmits the communication ID information COMID and the read-out command as the data signal SDA, in synchronization with the clock signal SCK. That is, the processing unit transmits the read-out command (the read-out command including the communication ID information COMID) in which the communication ID information COMID is set. After transmitting the read-out command, the input/output circuit of the data signal SDA is switched from an output mode to an input mode. After the switching into the input mode, the processing unit 210 receives the read-out data from the j-th memory unit 100-*j*.

In FIG. 10, the communication ID information COMID and the read-out command are constituted by 8 bits, but may be constituted by a number of bits other than 8 bits.

The storage device 110 of the printing apparatus 200 of the present embodiment receives the communication ID information COMID that is transmitted by the processing unit 210, and compares the received communication ID information COMID with its communication ID information COMID. When the two pieces of communication ID information COMID are consistent with each other, the storage device 110 subsequently decodes and executes the received read-out command. However, when the two pieces of communication ID information COMID are not consistent with each other, the storage device does not execute the read-out command.

In the printing apparatus 200 of the present embodiment, the storage device 110 stores common communication ID information that does not depend on an ink color, as communication ID information COMID. Therefore, the processing unit 210 can execute the read-out process by transmitting the same communication ID information COMID to each slot 230, that is, each memory unit 100, in the above-described process of detecting erroneous installation.

Figure 11:
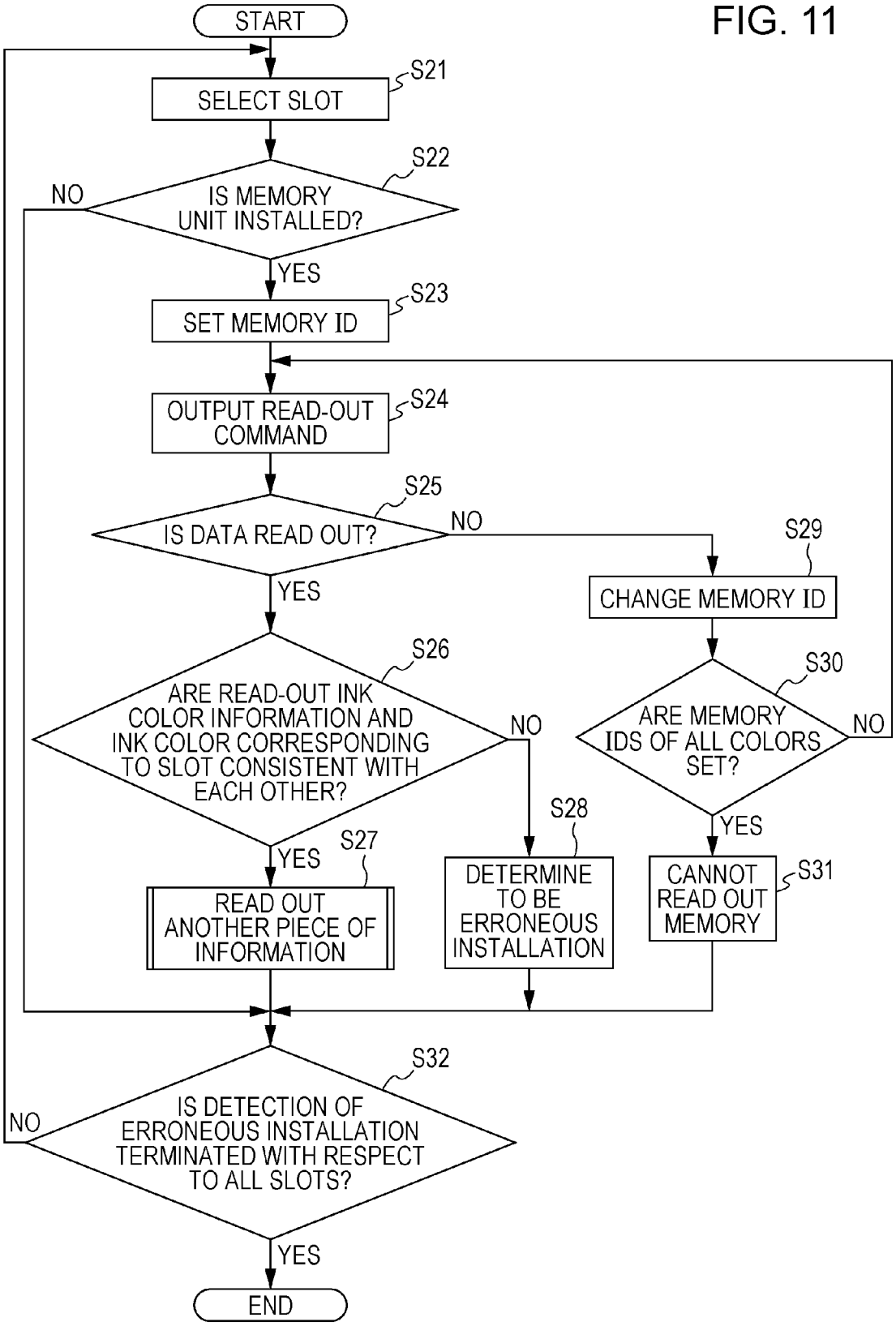
FIG. 11 is a flow chart illustrating detection of erroneous installation according to a comparative example.

FIG. 11 is a flow chart illustrating detection of erroneous installation when the storage device is configured to store different pieces of communication ID information (memory ID) corresponding to ink colors, according to a comparative example.

First, the slot to be detected is selected (step S21), and then it is detected whether the memory unit is installed (step S22). When the memory unit is installed, a memory ID is set (step S23), and a read-out command is output (step S24).

When the memory ID transmitted by the processing unit and the memory ID stored in the storage device are consistent with each other, the processing unit can receive read-out data. However, when both are not consistent with each other, the storage device does not execute a read-out command, and thus the processing unit cannot receive the read-out data. The processing unit determines whether data is read out (step S25). When the data is not read out, the processing unit changes the memory ID (step S29 and step S30), and outputs the read-out command again (step S24). In this manner, the processes are repeated until the processing unit can receive the read-out data because the memory ID transmitted by the processing unit and the memory ID stored in the storage device are consistent with each other.

When the processing unit receives the read-out data, it is determined whether the read-out ink color information and the ink color information corresponding to the slot are consistent with each other (step S26). When both are consistent with each other, the processing unit reads out another piece of information (step S27). When both are not consistent with each other, it is determined to be erroneous installation (step S28).

In addition, when data cannot be read out even though the memory IDs corresponding to all the ink colors are set to transmit the read-out command, the processing unit determines that a memory cannot be read out (step S31). When a memory error of the storage device, a communication error between the processing unit and the storage device, or the like occurs, the memory cannot be read out.

As illustrated in FIG. 11, in a configuration in which the storage device stores different pieces of communication ID information (memory IDs) corresponding to ink colors, the read-out command is required to be repeatedly transmitted until the memory IDs are consistent with each other. In addition, when data cannot be read out due to a memory error, a communication error, or the like, it cannot be determined that the memory cannot be read out unless the memory IDs corresponding to all ink colors are set to transmit the read-out command. As a result, it takes a long time to detect erroneous installation.

On the other hand, in the printing apparatus 200 of the present embodiment, erroneous installation can be detected with respect to all slots using one piece of communication ID information COMID, and thus the read-out command is transmitted once to one slot, thereby allowing the erroneous installation to be detected. In addition, even when data cannot be read out due to a memory error, a communication error, or the like, it is possible to determine that the memory cannot be read out, by transmitting the read-out command once. That is, when the read-out data is not transmitted from the storage device 110 with respect to the read-out command transmitted by the processing unit 210, it can be determined that a memory cannot be read. As a result, time required to detect the erroneous installation can be reduced.

4. Total Ink Consumption

The processing unit 210 executes a process of counting ink consumption for each ink color during printing, and updates total ink consumption information on the main body side for each ink color, on the basis of the counted ink consumption. The total ink consumption information on the main body side is stored in the storage unit 212 of the processing unit 210. Every time an amount of increase ΔWD in total ink consumption WD based on the total ink consumption information on the main body side exceeds a first threshold value WTH1, the total ink consumption WD based on the total ink consumption information on the main body side is written in the storage device 110 of the memory unit 100 corresponding to the ink color in the first to n-th memory units 100-1 to 100-*n*. Here, the amount of increase ΔWD in the total ink consumption WD is an amount of increase from the previous total ink consumption WD that is written in the storage device 110 by the processing unit 210. In this manner, it is preferable that a write process with respect to the storage device 110 be executed every time the total ink consumption WD increases by the first threshold value WTH1, and thus the number of write processes can be suppressed. As a result, it is possible to suppress the destruction of stored data due to a write error of the storage device 110. In addition, since it is possible to set a difference between the total ink consumption WDM written in the storage device 110 and the total ink consumption WD on the main body side to be equal to or less than the first threshold value WTH1, the total ink consumption can be reliably managed.

The first threshold value WTH1 is a value that is greater than a minimum value of ink consumption capable of being counted by the processing unit 210 and that is smaller than a second threshold value WTH2. For example, when the second threshold value WTH2 is 100%, the first threshold value WTH1 is 1%.

The total ink consumption can be expressed by a relative value (0 to 100%), for example, when an amount of ink accommodated in the ink pack 310 is set to 100%. The processing unit 210 reads out an initial filling amount of the ink pack 310 from the memory unit 100, and calculates the relative value from the filling amount of the ink pack and the amount of ink consumed. However, in an actual printing apparatus, ink consumption efficiency (printing efficiency) varies. That is, even though a printing process is executed using the same printing data, the ink consumption is not equal, and a printing apparatus with a high ink consumption or a printing apparatus with a low ink consumption is present.

Consequently, when the ink consumption efficiency of the printing apparatus 200 in which the memory unit 100 is installed is a lower limit within a predetermined range, a value corresponding to the total ink consumption WD that is estimated when ink corresponding to an amount of ink accommodated in the ink pack 310, which is packaged together with the memory unit 100, is consumed, is set as the second threshold value WTH2. The total ink consumption WD is expressed by a relative value (0 to 100%) by setting the second threshold value WTH2 to 100%.

The printing apparatus 200 with ink consumption efficiency which is a lower limit within a predetermined range is, for example, a printing apparatus having the lowest ink consumption efficiency in printing apparatuses that are shipped from the factory. Even in a case where the printing apparatus 200 is used, the printing can be performed until the total ink consumption WD reaches the second threshold value WTH2 (100%). In addition, when the total ink consumption WD reaches the second threshold value WTH2, the processing unit 210 can execute a process of displaying a message or the like for prompting a user to replenish ink, and thus the user can replenish the ink before the ink remaining in the ink tank 220 is all spent.

On the other hand, in a case where the printing apparatus 200 having the highest ink consumption efficiency is used, ink still remains in the ink tank 220 at the time the total ink consumption WD reaches the second threshold value WTH2 (100%), and thus the printing can be performed until the total ink consumption WD reaches, for example, 135%.

When the total ink consumption WD based on the total ink consumption information on the main body side is equal to or greater than the second threshold value WTH2 for defining the termination of use of the memory unit 100, the processing unit 210 can set the printing to be in an executable state even in a case where the memory unit 100 corresponding to the ink color is not installed. In this manner, when ink remains in the ink tank 220 even in a case where the total ink consumption WD is equal to or greater than the second threshold value WTH2 (100%), the printing can be continued using the remaining ink.

Since the ink tank 220 is provided with an ink end sensor for detecting that ink is all spent, the processing unit 210 can stop printing on the basis of detection of an ink end through the ink end sensor.

In this manner, according to the printing apparatus 200 of the present embodiment, even in a printing apparatus having the lowest ink consumption efficiency, a user can perform printing with an easy mind without caring about the amount of remaining ink until the total ink consumption reaches the second threshold value WTH2. Since a message for prompting the user to replenish ink is displayed at the time the total ink consumption reaches the second threshold value WTH2, the user can replenish the ink in the ink tank 220 from the ink pack 310 and can replace the memory unit 100 in which use termination information is written with a new (an initial state) memory unit 100 (use termination information is not written, and ink consumption count is 0%).

Further, according to the printing apparatus 200 of the present embodiment, in a case where ink remains in the ink tank 220 at the time the total ink consumption reaches the second threshold value WTH2, the printing can be continued without any change. A user can replenish ink and replace the memory unit 100 by determining an ink replenishment time. In addition, when the total ink consumption WD is equal to or greater than the second threshold value WTH2, the printing can be performed even when the memory unit 100 is not installed, thereby allowing the ink to be replenished and allowing the memory unit 100 to be replaced, without stopping the printing in a case of, for example, a time-consuming printing. Alternatively, the printing can be continued by only replenishing ink without replacing the memory unit 100.

When the total ink consumption WDM written in the storage device 110 of the memory unit 100 is less than the second threshold value WTH2 after power is applied to the printing apparatus 200 or after any one memory unit 100 of the first to n-th memory units 100-1 to **100-*n* is replaced, the processing unit 210 rewrites the total ink consumption information on the main body side to a value that is the same as the total ink consumption WDM that is written in the storage device 110 of the memory unit 100. In this manner, it is possible to set the total ink consumption WDM written in the storage device 110 and the total ink consumption WD on the main body side to have the same value. In addition, when ink is replenished and the memory unit 100** is replaced, the total ink consumption information on the main body side can be rewritten to an initial value (0%).

As described above, according to the printing apparatus 200 of the present embodiment, the erroneous installation of the memory unit 100 can be detected, and thus a user's erroneous installation can be prevented. Further, since the memory unit 100 stores the common communication ID information COMID that does not depend on an ink color, the erroneous installation can be detected in a short time. In addition, when ink remains in the ink tank 220 even though the total ink consumption WD is equal to or greater than the second threshold value WTH2, the printing can be continued using the remaining ink. Alternatively, in a case of a time-consuming printing, the printing can be continued by replenishing ink without stopping the printing.

In this manner, according to the printing apparatus 200 of the present embodiment, it is possible to realize a printing apparatus that has a high convenience and a high reliability for a user.

Meanwhile, the present embodiment has been described above in detail, but it would have been obvious to one of ordinary skill in the art that various modifications can be made without substantially departing from the novel matter and effects of the invention. Therefore, all the modification examples are included within the scope of the invention. For example, in the specification or the drawings, terms that are described at least once together with different terms having a broader meaning or the same meaning can be replaced with the different terms in any place of the specification or the drawings. In addition, the configurations and operations of the printing apparatus and the ink pack set are not limited to those described in the present invention, and can be implemented in various ways.

In the present embodiment, an ink pack in which ink is filled in a pouch pack has been described as an ink pack, but the ink pack is not limited thereto. The ink pack includes, for example, a bottle constituted by plastic or a container constituted by a flexible material.

The entire disclosure of Japanese Patent Application No. 2012-191097, filed Aug. 31, 2012 is expressly incorporated by reference herein.

What is claimed is:

1. A printing apparatus comprising:

a first ink tank to an n-th (n is an integer equal to or greater than 2) ink tank in which ink accommodated in an ink pack is filled;

a first slot to an n-th slot that respectively correspond to the first ink tank to the n-th ink tank;

a first memory unit to an n-th memory unit that are packaged together with the ink pack and are respectively installed in the first slot to the n-th slot; and a processing unit that controls read-out from or writing to the first memory unit to the n-th memory unit that are respectively installed in the first slot to the n-th slot, wherein each of the first memory unit to the n-th memory unit has a storage device, wherein the storage device stores common communication ID information that does not depend on an ink color, and ink color information corresponding to the ink color of the ink pack with which the memory unit having the storage device is packaged, and wherein the processing unit selects the j-th (j is an integer satisfying the relation of $1 \leq j \leq n$) slot from the first slot to the n-th slot, outputs a read-out command in which the communication ID information is set, to the storage device included in the j-th memory unit of the first memory unit to the n-th memory unit, which is installed in the j-th slot, determines whether ink color information that is read out based on the read-out command and an ink color corresponding to the j-th slot are consistent with each other, and determines that the j-th memory unit is erroneously installed when the read-out ink color information and the ink color corresponding to the j-th slot are inconsistent with each other.

2. The printing apparatus according to claim 1, wherein each of the first memory unit to the n-th memory unit has a storage device terminal, and wherein the processing unit outputs a predetermined signal to the storage device terminal of the j-th memory unit that is installed in the j-th slot so as to set the storage device of the j-th memory unit to be in a communicable state, and outputs the read-out command in which the communication ID information is set, to the storage device that is set to be in a communicable state.

3. The printing apparatus according to claim 2, wherein each of the first memory unit to the n-th memory unit has a reset terminal as the storage device terminal, and wherein the processing unit outputs a reset release signal as the predetermined signal to the reset terminal so as to set the storage device to be in the communicable state.

4. The printing apparatus according to claim 1, wherein each of the first memory unit to the n-th memory unit has an installation detection terminal, and wherein the processing unit detects that the j-th memory unit is installed in the j-th slot, using the installation detection terminal, and then outputs the read-out command, to the storage device of the j-th memory unit.

5. The printing apparatus according to claim 1, wherein the processing unit executes a process of counting ink consumption for each ink color during operating printing apparatus, updates total ink consumption information on the main body side for each ink color on the basis of the counted ink consumption, writes total ink consumption based on the total ink consumption information on the main body side to the storage device of the memory unit corresponding to the ink color in the first memory unit to the n-th memory unit, every time an amount of increase in the total ink consumption based on the total ink consumption information on the main body side exceeds a first threshold value, and sets the printing apparatus to be in an print operable state even in a case where the memory unit corresponding to the ink color is not installed when the total ink consumption based on the total ink consumption information on the main body side is equal to or greater than a second threshold value for defining termination of use of the memory unit.

6. The printing apparatus according to claim 1, further comprising a slider that is installable each of the first slot to the n-th slot, wherein the k-th (k is an integer satisfying the relation of $1 \leq k \leq n$) memory unit of the first memory unit to the n-th memory unit is detachably mounted on the slider, and the slider on which the k-th memory unit is mounted is installed in the k-th slot of the first slot to the n-th slot, and thus the k-th memory unit is installed in the k-th slot.

7. An ink pack set comprising:

an ink pack that accommodates ink to be used in a printing apparatus; and a memory unit that is installed in the printing apparatus, wherein the memory unit includes a storage device, the storage device stores common communication ID information that does not depend on an ink color of the ink pack and ink color information corresponding to the ink color of the ink pack, the ink accommodated in the ink pack is filled in an ink tank that is included in the printing apparatus, the memory unit is installed in a slot, which is included in the printing apparatus and corresponds to the ink tank, and data is read out or written under the control of a processing unit that is included in the printing apparatus, in the storage device of the memory unit that is installed in the slot.

8. A printing apparatus comprising:

a first ink tank to an n-th (n is an integer equal to or greater than 2) ink tank in which ink accommodated in an ink pack is filled;

a first slot to an n-th slot that respectively correspond to the first ink tank to the n-th ink tank;

a first memory unit to an n-th memory unit that are respectively installed in the first slot to the n-th slot; and a processing unit that controls read-out from or writing to the first memory unit to the n-th memory unit that are respectively installed in the first slot to the n-th slot, wherein each of the first memory unit to the n-th memory unit has a storage device, wherein the storage device stores common communication ID information that does not depend on an ink color, and wherein the processing unit selects the j-th (j is an integer satisfying the relation of $1 \leq j \leq n$) slot from the first slot to the n-th slot, outputs a read-out command in which the communication ID information is set, to the storage device included in the j-th memory unit of the first memory unit to the n-th memory unit, which is installed in the j-th slot, determines whether ink color information that is read out based on the read-out command and an ink color corresponding to the j-th slot are consistent with each other, and determines that the j-th memory unit is erroneously installed when the read-out ink color information and the ink color corresponding to the j-th slot are inconsistent with each other.

* * * * *